US006814082B2

(12) United States Patent
Lorenzen

(10) Patent No.: US 6,814,082 B2
(45) Date of Patent: Nov. 9, 2004

(54) APPARATUS AND METHOD FOR GENERATING INFORMATION ON THE CHARACTERISTICS OF A FIBER ROPE

(75) Inventor: Heinz-Christen Lorenzen, Wentorf (DE)

(73) Assignee: Hauni Maschinenbau AG, Hamburg (DE)

( * ) Notice: Subject to any disclaimer, the term of this patent is extended or adjusted under 35 U.S.C. 154(b) by 128 days.

(21) Appl. No.: 10/116,120

(22) Filed: Apr. 5, 2002

(65) Prior Publication Data

US 2002/0144699 A1 Oct. 10, 2002

(30) Foreign Application Priority Data

Apr. 6, 2001 (DE) ..... 101 17 081

(51) Int. Cl.[7] ..... A24C 5/32

(52) U.S. Cl. ..... 131/280; 131/84.1; 131/905; 131/906

(58) Field of Search ..... 131/280, 282, 131/286, 287, 84.1, 905, 906; 209/536; 356/432

(56) References Cited

U.S. PATENT DOCUMENTS

| | | | | |
|---|---|---|---|---|
| 4,280,187 A | | 7/1981 | Reuland et al. | |
| 4,638,817 A | | 1/1987 | Okumoto | |
| 4,865,054 A | | 9/1989 | Lorenzen et al. | |
| 4,920,987 A | | 5/1990 | Okumoto | |
| 4,941,482 A | * | 7/1990 | Heitmann et al. | 131/84.4 |
| 4,967,739 A | | 11/1990 | Wochnowski | |
| 5,582,192 A | | 12/1996 | Williams, III | |
| 6,163,158 A | | 12/2000 | Moeller et al. | |
| 6,421,126 B1 | * | 7/2002 | Kida et al. | 356/432 |

FOREIGN PATENT DOCUMENTS

| | | |
|---|---|---|
| DE | 28 42 461 C2 | 4/1980 |
| DE | 38 01 115 C2 | 8/1988 |
| DE | 39 17 606 A1 | 12/1989 |
| DE | 197 05 260 A1 | 8/1997 |
| EP | 0 339 250 B1 | 11/1989 |
| EP | 0 793 425 B1 | 9/1997 |

* cited by examiner

*Primary Examiner*—Peter Chin
*Assistant Examiner*—Carlos Lopez
(74) *Attorney, Agent, or Firm*—Venable LLP; Robert Kinberg

(57) ABSTRACT

The invention relates to a method and a device for providing information on the fiber structure, particularly for determining deviations from an average fiber structure, of a fiber rope in the tobacco-processing industry and especially a tobacco rope. A first measuring device generates a first measuring signal that essentially only indicates the density of the fiber rope. A second measuring device generates a second measuring signal that represents a function of fiber rope density and fiber geometry. An evaluation device uses the first and second measuring signals to generate an evaluation signal which provides information on the fiber structure, particularly the deviations from an average fiber structure.

21 Claims, 7 Drawing Sheets

APPARATUS AND METHOD FOR GENERATING INFORMATION ON THE CHARACTERISTICS OF A FIBER ROPE

CROSS-REFERENCE TO RELATED APPLICATIONS

Reference is made to German Application No. 10117 081.5 filed in Germany on Apr. 6, 2001, the disclosure of which, along with the disclosure of each U.S. and foreign patent and patent application referred to herein, is incorporated herein by reference.

BACKGROUND OF THE INVENTION

The invention relates to an apparatus and a method for generating information on at least one characteristic of a fiber rope in the tobacco-processing industry, in particular a tobacco rope.

German patent document No. 38 01 115 C2 and corresponding U.S. Pat. No. 4,865,054 disclose a method and an apparatus for determining the density of a fiber rope. According to these documents, a nuclear measuring head generates a first density signal and an optical measuring head, in particular an infrared measuring head, generates a second density signal, which signals are used to remove undesirable influences, such as type and color of the tobacco for the fiber rope.

A method and an apparatus for detecting and localizing malfunctions in cigarette-producing machines are disclosed in German patent document 28 42 461 C2 and corresponding U.S. Pat. No. 4,280,187, wherein test signals generated by a nuclear measuring head are monitored for the appearance of different, characteristic signal components, which are respectively assigned to a specific machine element. Several test signals can be evaluated for this and related to each other.

German patent document 39 17 606 A1 and corresponding U.S. Pat. No. 4,967,739 disclose a method and an apparatus for producing cigarettes in which a density measuring signal and at least one additional measuring signal indicating another characteristic of the tobacco rope are correlated. From these selected cigarette characteristics tractive resistance, burn~down time, nicotine content, condensate content, carbon monoxide content and rope hardness are displayed.

German patent document 197 05 260 A1 and corresponding U.S. Pat. No. 6,163,158 disclose a method and an apparatus for detecting at least one characteristic of a material, particularly the humid weight and/or the dry weight of tobacco, by evaluating detuning, due to the presence of the material, of a high-frequency resonator supplied with microwaves from a respective radiation source. Based on this, a high-frequency signal is produced, which is influenced by the material. The resonance frequency displacement and attenuation of this signal relative to a reference signal that is not influenced by the material are detected, so that the material characteristic can be determined from this.

U.S. Pat. No. 4,638,817 describes a tobacco feed control with two radiometric density sensors. A differential signal is formed from the signals generated by these two sensors and an alarm signal is generated if the differential signal exceeds a limit value considered normal.

European Patent Application No. 0 339 250 B1 and corresponding U.S. Pat. No. 4,920,987 disclose a system for controlling the tobacco filling amount in a cigarette production machine, provided with a first radiometric density measuring device in front of a trimmer and second radiometric density measuring device at a location where the previously wrapped tobacco rope passes by. The system further includes an advancing control and an automatic control circuit, for which the trimmer serves as adjustment member.

Finally, European Patent Application No. 0 793 425 B1 and corresponding U.S. Pat. No. 5,582,192 discloses a method and a device for diagnosing mechanical problems during the cigarette production. For this, a weight sensor is provided that emits signals, which can be used to generate error messages with a Fast Fourier Frequency Analysis, showing a possible abnormal state.

SUMMARY OF THE INVENTION

It is an object of the present invention to provide a method and an apparatus of the aforementioned type, which make it possible to obtain information on the fiber structure and in particular on deviations from an average fiber structure.

The above and other objects are accomplished in accordance with the invention by the provision of solved according to the invention with an apparatus comprising a first measuring device for generating a first measuring signal, which essentially only indicates the density of the fiber rope and a second measuring device for generating a second measuring signal, which essentially shows only a function of fiber rope density and fiber geometry. The apparatus also comprises an evaluation unit that uses the results of the first and second measuring signals to generate an evaluation signal providing information on the fiber structure, in particular on deviations from an average fiber structure.

The object is furthermore solved with a method for generating a first measuring signal that essentially only indicates the density of the fiber rope, a second measuring signal that essentially represents a function of fiber rope density and fiber geometry. The method is also used to generate an evaluation signal on the basis of the first and second measuring signals, which provides information on the fiber structure, in particular on the deviations from an average fiber structure.

For reasons of completeness, it must be mentioned here that the terms "measuring signal" and "evaluation signal" also can be understood as measuring value or result value.

The invention provides information on the fiber structure and in particular the deviations from an average structure of a fiber rope. According to the invention, this is achieved by relating a first measuring signal that essentially only indicates the density of the fiber rope to a second signal that represents a function of fiber density and fiber geometry, such that the density is blanked out and an evaluation signal is obtained, which is essentially determined by the fiber geometry, from which the fiber structure can be inferred. From this, it can be inferred whether specific machine parts on a tobacco-rope production line are worn and, in particular, whether irregularities exist at the feeder, as well as abnormal tobacco destruction in the conveying lines and/or abnormal tobacco end mixtures and/or tobacco destruction in the distributor. In particular deviations from an average fiber structure value lead to the conclusion of at least one of the aforementioned malfunctions.

It is advantageous if beta and/or microwave radiation that penetrates the fiber rope is transmitted from a first radiation source and, following the penetration, is picked up by a first sensor that generates a first measuring signal, which essentially only provides the density of the fiber rope. Thus, a first measuring signal is generated at the fiber rope for the density of the fiber rope with beta and/or microwave radiation. For at least some of the previously mentioned known methods and apparatuses, this signal has until now served as basis for a weight adjustment.

A second radiation source furthermore emits an infrared radiation that penetrates the fiber rope and is picked up by a second sensor, which generates from this a second measuring signal representing a function of fiber rope density and fiber geometry. Thus, the second measuring signal is generated through absorption of infrared light by the fiber rope The second measuring signal gained through the infrared light absorption, however, depends not only on the density, but also to a high degree on the fiber geometry and in particular the fiber length. In the final analysis, the weight adjustment on the basis of the infrared light absorption failed because of this dependence on the structure. However, since the weight must not be detected and adjusted for the present case, but information on the fiber structure is desired, it is of particular use to the invention that the infrared absorption also depends on the fiber geometry. According to the invention, the desired evaluation signal that is essentially determined only by the fiber geometry is obtained from the infrared light absorption by linking it to the first measuring signal, which only provides the density of the fiber rope and thus is an essentially 'pure' density signal.

A malfunction in the process sequence can be inferred if this evaluation signal falls below or exceeds a limit value considered normal. In that case, the evaluation device advantageously transmits a corresponding warning signal. The locations of malfunctions can be narrowed down further with the aid of additional embodiments.

The difference between the first and second measuring signal is advantageously determined for generating an evaluation signal. Thus, the fiber geometry is determined by forming the differential value between the first measuring signal, essentially representing a pure density signal, and the second measuring signal that depends on the density as well as the structure.

The first and second measuring devices can be arranged one behind the other along the conveying path for the fiber rope, wherein the order in which they are arranged is basically optional. The first and second measuring signals for this exemplary embodiment consequently are determined at the finished fiber rope.

It is also conceivable that the second measuring signal is determined on a suction rope conveyor, behind the trimmer of a production line for processing a tobacco rope.

The first measuring signal that essentially only provides the density can preferably also be used as an actual value for a control system to adjust the weight of the fiber rope to be produced.

Another preferred embodiment of the invention with a device for producing the fiber rope and a subsequent device for conveying and wrapping the produced fiber rope, is distinguished by a third measuring device in the production apparatus. This third measuring device generates a third measuring signal, preferably at its output, which essentially only indicates the fiber rope density. This embodiment furthermore is distinguished in that the first and second measuring devices are arranged along the conveying device, downstream of the location where the fiber rope is wrapped, and that the evaluation device additionally uses the third measuring signal. According to a modification of this embodiment, infrared radiation can be used to generate the third measuring signal.

Finally, a system comprising several of the above-described apparatuses along with a central comparator can be provided, to which the evaluation devices are connected. To be sure, it several cigarette-production machines are supplied by a single feeder, it is possible to detect unfavorable conditions in one or the other conveying line or wear on the machine parts by detecting and comparing the structure of the tobacco in the tobacco ropes and cigarette ropes in the machines. In a double-rope machine, for example, a comparison of the two ropes can lead to a conclusion that an abnormal end mixture or abnormal tobacco destruction on a tobacco path exist, for example through wear of the structural components. Furthermore, a comparison between different machines supplied by the same feeder can lead to the conclusion that the momentarily produced tobacco mixture no longer meets the standard if all machines show approximately the same deviation. The same conclusion of a malfunction on the path from the feeder to the cigarette machine can be reached if only one of the machines shows a deviation that results, for example, from an erroneous adjustment or a worn structural component.

BRIEF DESCRIPTION OF THE DRAWINGS

Preferred exemplary embodiments of the invention are explained in further detail in the following with the aid of the drawings.

DETAILED DESCRIPTION OF THE DISCLOSURE

Figure 1:
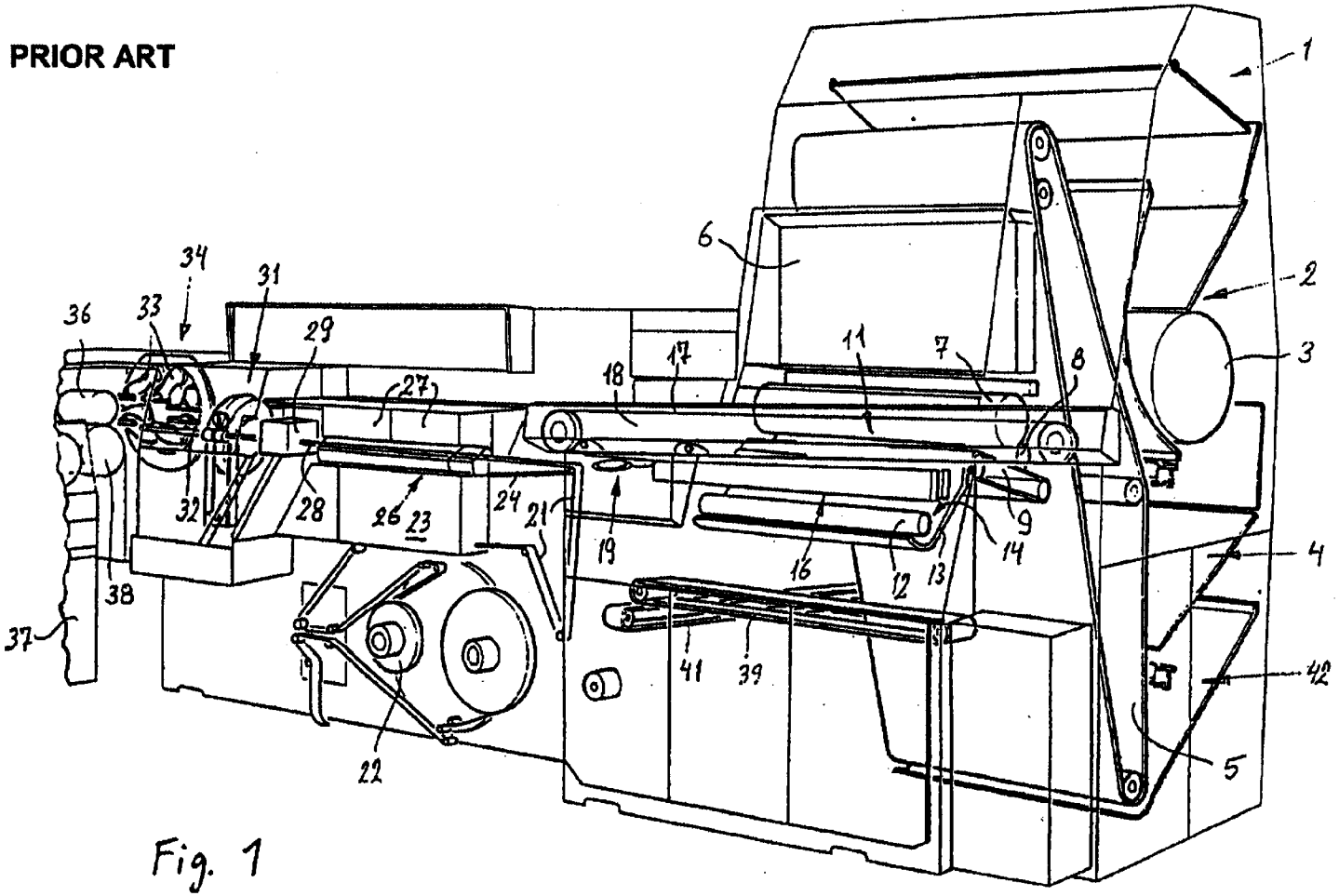
PRIOR ART Fig. 1
FIG. 1 is a schematic, three-dimensional representation of a know design of a cigarette rope machine.

FIG. 1 shows the basic design of a cigarette rope machine known as type "Protos," manufactured by the assignee of the present application. According to this design, a pre-distributor 2 is supplied with loose tobacco from a lock 1. An extraction roller 3 for the pre-distributor 2 is controlled, so as to replenish a storage container 4 with tobacco. From this storage container, a vertical conveyor 5, designed as an endless belt and guided over various rollers not shown in further detail in FIG. 1, removes tobacco and controllably feeds it to a retaining shaft 6. A pin roller 7 removes a uniform flow of tobacco from retaining shaft 6. The tobacco is knocked from the pins of pin roller 7 with a knock-out roller 8 and thrown onto a spreading cloth 9 that circulates at a constant speed and is guided as an endless belt over various rollers not shown in further detail in FIG. 1. A tobacco fleece formed on the spreading cloth 9 is thrown into a sorting device 11 that creates an air curtain through which larger or heavier tobacco particles pass while the remaining tobacco particles are guided by the air curtain into a funnel 14, formed by a pin roller 12 and a wall 13.

From the pin roller 12, the tobacco is thrown into a tobacco channel 16 and against a rope conveyor 17, on which the tobacco is held in place with air sucked into a vacuum chamber 18 and is piled into a tobacco rope. A stripper or trimmer 19, essentially consisting of a pair of rotating disks and a diverter arranged in the plane for the tobacco rope conveyor, removes excess tobacco from the tobacco rope. In the process, the trimmer 19 removes the excess tobacco and cuts the tobacco rope to the desired thickness.

The tobacco rope is subsequently placed onto a cigarette paper tape 21, which moves along at the same speed. The cigarette paper tape 21 is pulled from a bobbin 22, is guided through a printing mechanism 22, transported via different rollers not shown with further detail in FIG. 1 and placed onto a driven sizing belt 24. The sizing belt 24, which is also an endless belt guided over several rollers that are not shown herein, conveys the tobacco rope and the cigarette paper tape 21 through a sizing device 26. In this device, the cigarette paper tape 21 is folded around the tobacco rope, so that one edge still points outward. Glue is applied in a manner known per se to this edge with a gluing device not shown herein. Following this, the glue seam is closed and dried with a tandem smoothing iron 27.

A cigarette rope 28 formed in this way passes through a rope-density measuring device 29, which controls the trimmer 19, and is divided with a knife apparatus 31 into double-length cigarettes 32. The double-length cigarettes 32 are transferred with the transfer device 34 with controlled arms 33 of a takeover drum 36 to a filter-attachment machine 37. On the cutting drum 38 of this filter-attachment machine, double-length cigarettes are cut with a circular knife into individual cigarettes. With endless conveyor belts 39, 41 guided over rollers that are not further designated, excess tobacco is transported into a container 42 that is arranged below the storage container 4. The tobacco is removed once more from this container with the vertical conveyor 5.

Figure 2:
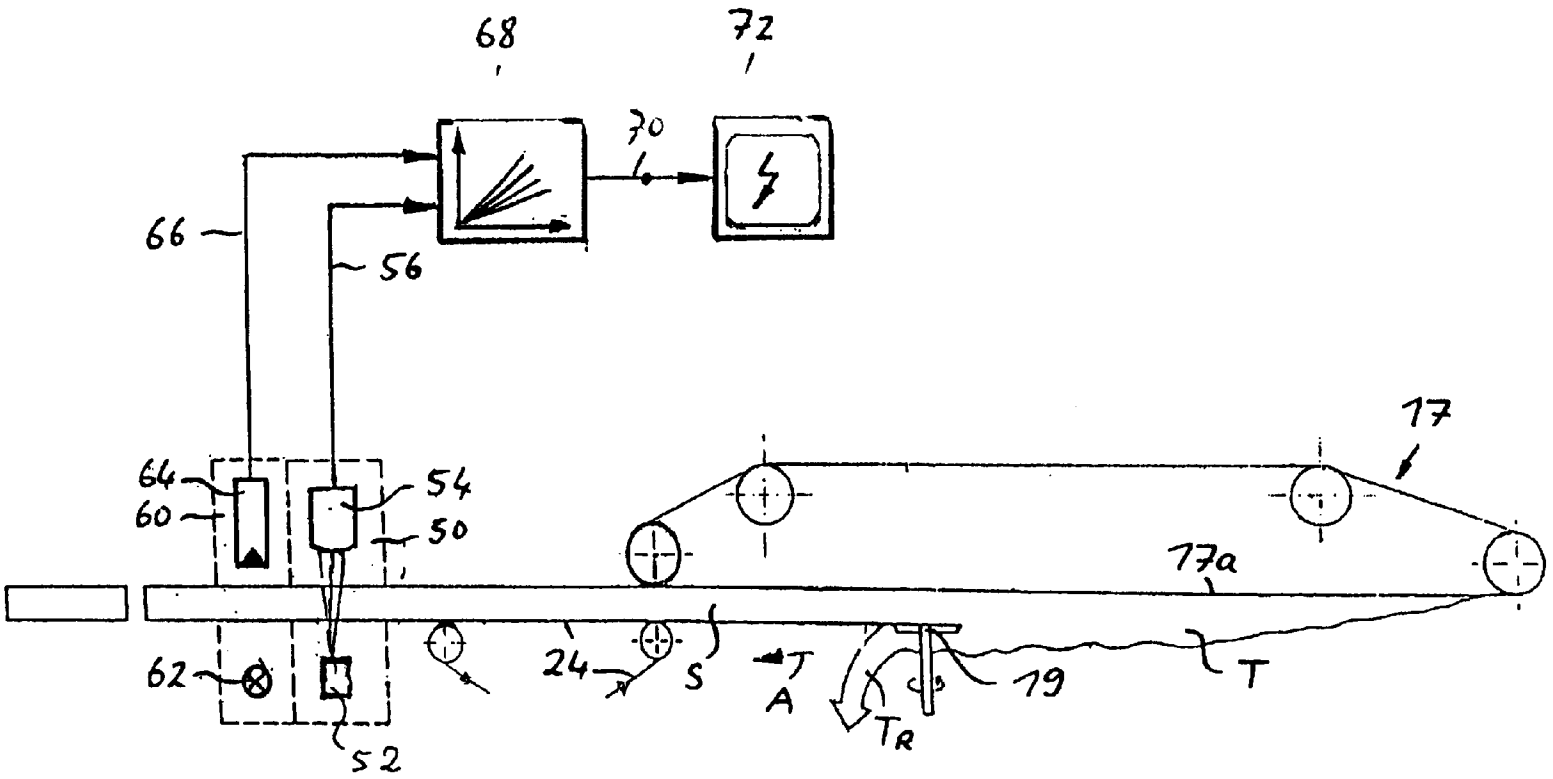
FIG. 2 is a schematic showing a first embodiment of an apparatus for determining the tobacco structure of the tobacco rope produced in the machine shown in FIG. 1.

FIG. 2 schematically shows an apparatus or measuring device for determining the fiber structure or tobacco structure of a tobacco rope produced in a machine according to FIG. 1.

The apparatus according to FIG. 2 is implemented in the machine shown in FIG. 1. Accordingly, FIG. 2 again shows the rope conveyor 17 previously shown in FIG. 1, which consists of an endless belt guided over rollers that are not further defined herein. For the exemplary embodiment shown, the lower belt section 17*a* of the rope conveyor 17 extends in conveying direction A of the tobacco rope S. With the aid of the vacuum chamber 18 (indicated in FIG. 1 but not shown in FIG. 2), the tobacco is suctioned against the underside of the lower belt section 17*a* of rope conveyor 17 and is held in place there, as shown in FIG. 2. Also shown in FIG. 2 is the trimmer 19, which trims off excess tobacco $T_R$ for forming the tobacco rope S, as previously shown in FIG. 1. FIG. 2 furthermore shows a section of the sizing belt 24 for the machine according to FIG. 1. The sizing belt 24 takes over the tobacco rope S from the rope conveyor 17 and thus functions, among other things, also as a conveying device downstream of the rope conveyor 17. For reasons of clarity, the cigarette paper tape 21 that is carried by the sizing belt 24 is omitted in FIG. 2.

FIG. 2 shows a first measuring device 50 which is installed in front of the knife apparatus 31 shown in FIG. 1. This measuring device is installed downstream of the discharge for rope conveyor 17, meaning in the direction of arrow A that indicates the conveying direction of the tobacco rope S. The first measuring device 50 is provided with a first radiation source 52, which sends out beta or microwave radiation that penetrates the tobacco rope S. The first measuring device furthermore has a first sensor 54, arranged on the opposite side of the tobacco rope S passing through, which picks up the radiation once it has penetrated the tobacco rope S and emits a first measuring signal 56.

In the embodiment shown in FIG. 2, the first measuring device 50 is followed by a second measuring device 60 through which the tobacco rope S passes as well. The second measuring device 60 is provided with a second radiation source 62 that radiates infrared light through the tobacco rope S, as well as a second sensor 64 that picks up the infrared light after it penetrates the tobacco rope S and generates a corresponding second measuring signal 66. FIG. 2 also shows that the second sensor 64 is accordingly arranged on the opposite side of the tobacco rope S, relative to the second radiation source 62.

The first measuring signal 56 generated by the first measuring device 50 is a tobacco density signal while the second measuring signal 66, generated as a result of infrared light absorption by the second measuring device 60, depends not only on the tobacco density, but to a high degree also on the tobacco structure and in particular the fiber length.

The first and second measuring signals 56 and 66 are evaluated in a subsequent evaluation device 68, such that an evaluation signal 70 is generated, which provides information on the fiber structure. Thus, the first and second measuring signals 56 and 66 are linked in the evaluation device 68 so that with the aid of the first measuring signal 56 that essentially only indicates the density of the tobacco rope S, the density can be computed out of the second measuring signal 66. The evaluation signal 70 that is essentially determined only by the tobacco structure is thus obtained from the second measuring signal 66, preferably through forming the difference between the first and second measuring signals 56 and 66.

The evaluation signal 70 subsequently is transmitted from the evaluation device 68 to a monitoring device 72, for example comprising a monitor for displaying information on the fiber structure on the basis of the evaluation signal 70.

In general, it is sufficient to indicate deviations from a predetermined average tobacco structure with the aid of the apparatus described in FIG. 2 to obtain information on the process sequence. A malfunction in the process sequence can be inferred, in particular, if the evaluation signal 70 exceeds or falls below a limit value that must be considered normal. Alternatively, it is also conceivable to store matrixes, characteristic values and/or characteristic curves in the evaluation device 68, which can be used to link the measuring signals and to infer corresponding results from this. The areas of malfunction can be further narrowed down with additional embodiments.

Figure 3:
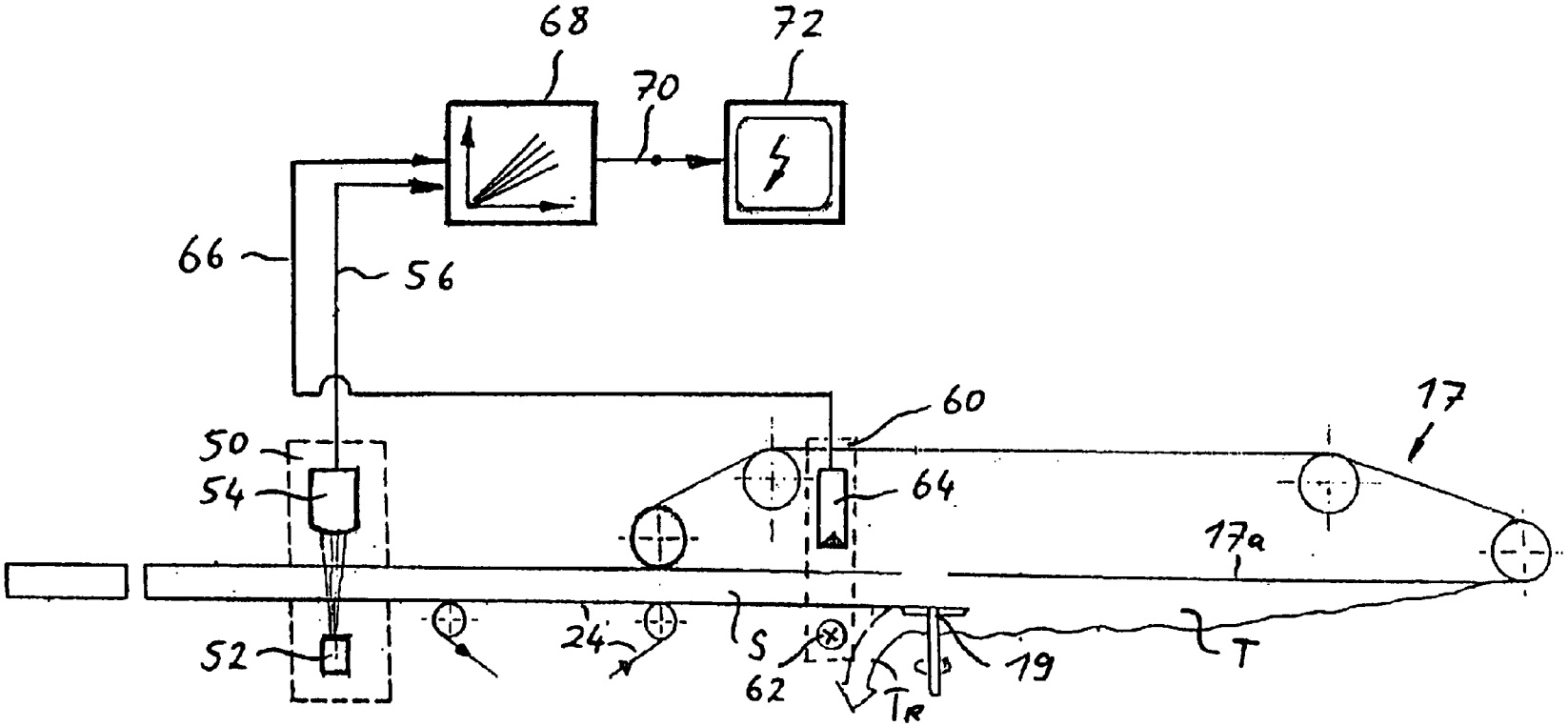
FIG. 3 is a schematic of a second embodiment of an apparatus for determining the tobacco structure of the tobacco rope produced in the machine shown in FIG. 1.

The second design shown in FIG. 3 differs from the first design shown in FIG. 2 in that a second measuring device 60 is arranged in the movement direction of the tobacco rope S directly behind the trimmer 19, in the discharge region of rope conveyor 17 and in front of the measuring device 50.

Figure 4:
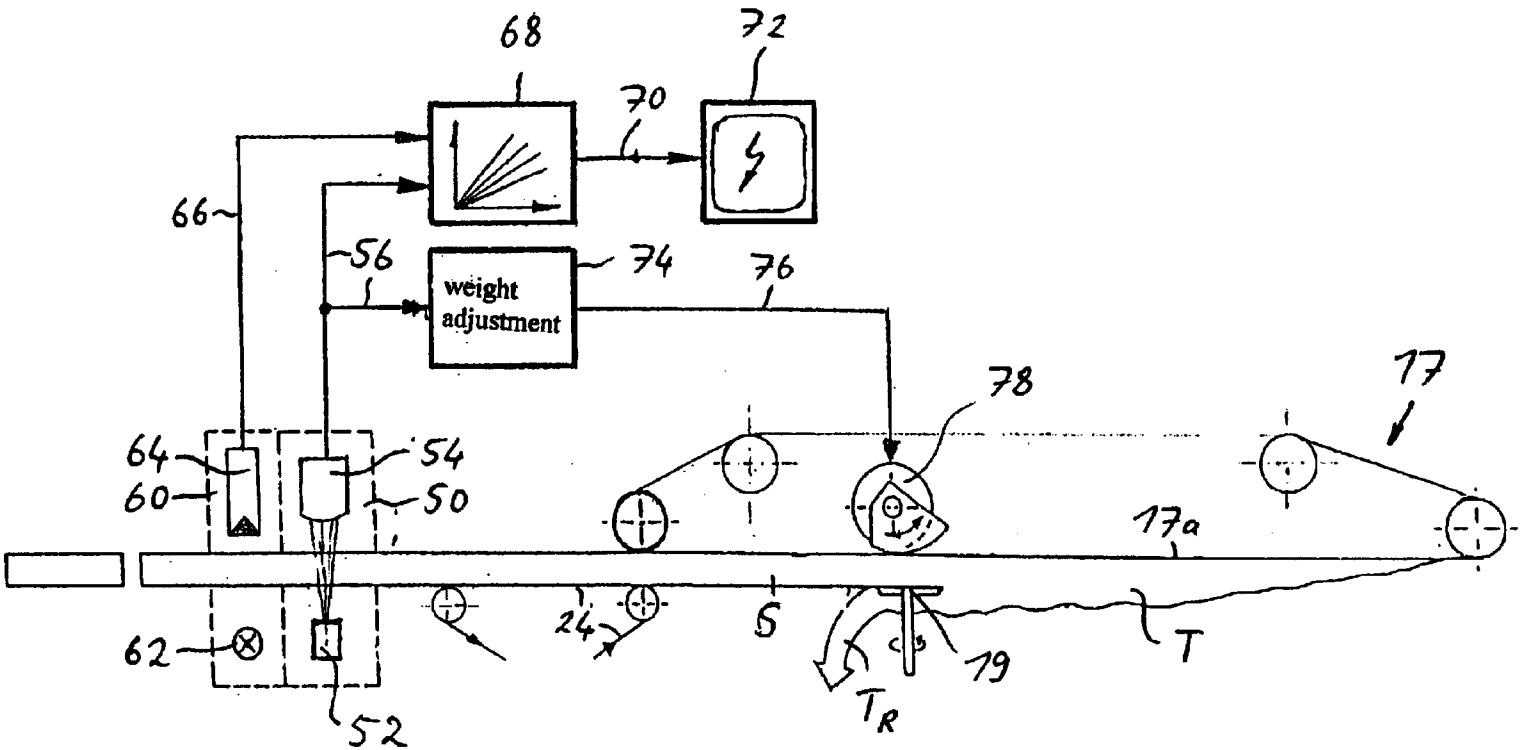
FIG. 4 is a schematic of a third embodiment of an apparatus for determining the tobacco structure of the tobacco rope produced in the machine shown in FIG. 1.

A third embodiment is shown in FIG. 4, which differs from the first and second embodiments according to FIGS. 2 and 3 in that the first measuring signal 56 from the first measuring device 50 is additionally also used for the weight adjustment. For this, the first measuring signal 56 also functions as an actual signal for a controller 74, which generates a corresponding adjustment signal 76 that activates an adjustment member 78 for adjusting the density and thus the weight of the tobacco rope S.

Figure 5:
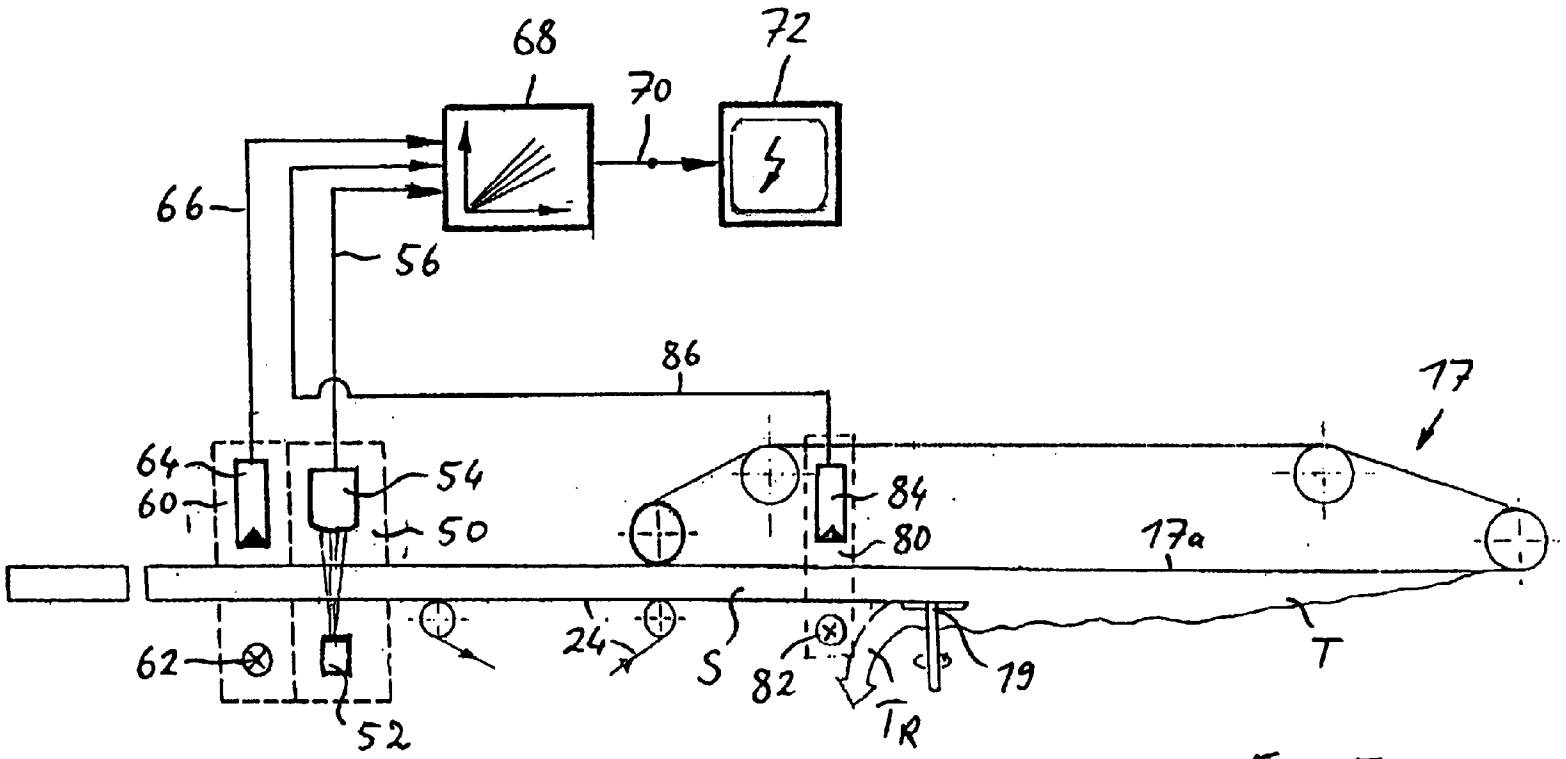
FIG. 5 is a schematic of a fourth embodiment of an apparatus for determining the tobacco structure of the tobacco rope produced in the machine shown in FIG. 1.

A fourth embodiment shown in FIG. 5 differs from the first embodiment according to FIG. 2 in that a third measuring device 80 is provided in addition to the first and second measuring devices 50 and 60. This measuring device is installed approximately at the same location as the second measuring device 60 in the second embodiment according to FIG. 3. The design of the third measuring device 80 is identical to the design for the second measuring device 60, meaning it operates optically using infrared light and is provided with a third radiation source 82, which produces infrared radiation that penetrates the tobacco rope S. The measuring device also has a third sensor 84, arranged on the opposite side relative to the tobacco rope S, which picks up the infrared radiation after it penetrates the tobacco rope S and generates a corresponding third measuring signal 86. This third measuring signal 86 is compared in the evaluation device 68 to the signal 66. If the signals differ, the deviation is transmitted to the monitoring device 72 and is displayed there. The deviation between signals 86 and 66 indicates that the tobacco rope deviates between the third sensor 84 and the second sensor 64, thus indicating an incorrect adjustment or wear of the sizing device 26 in FIG. 1.

Figure 6:
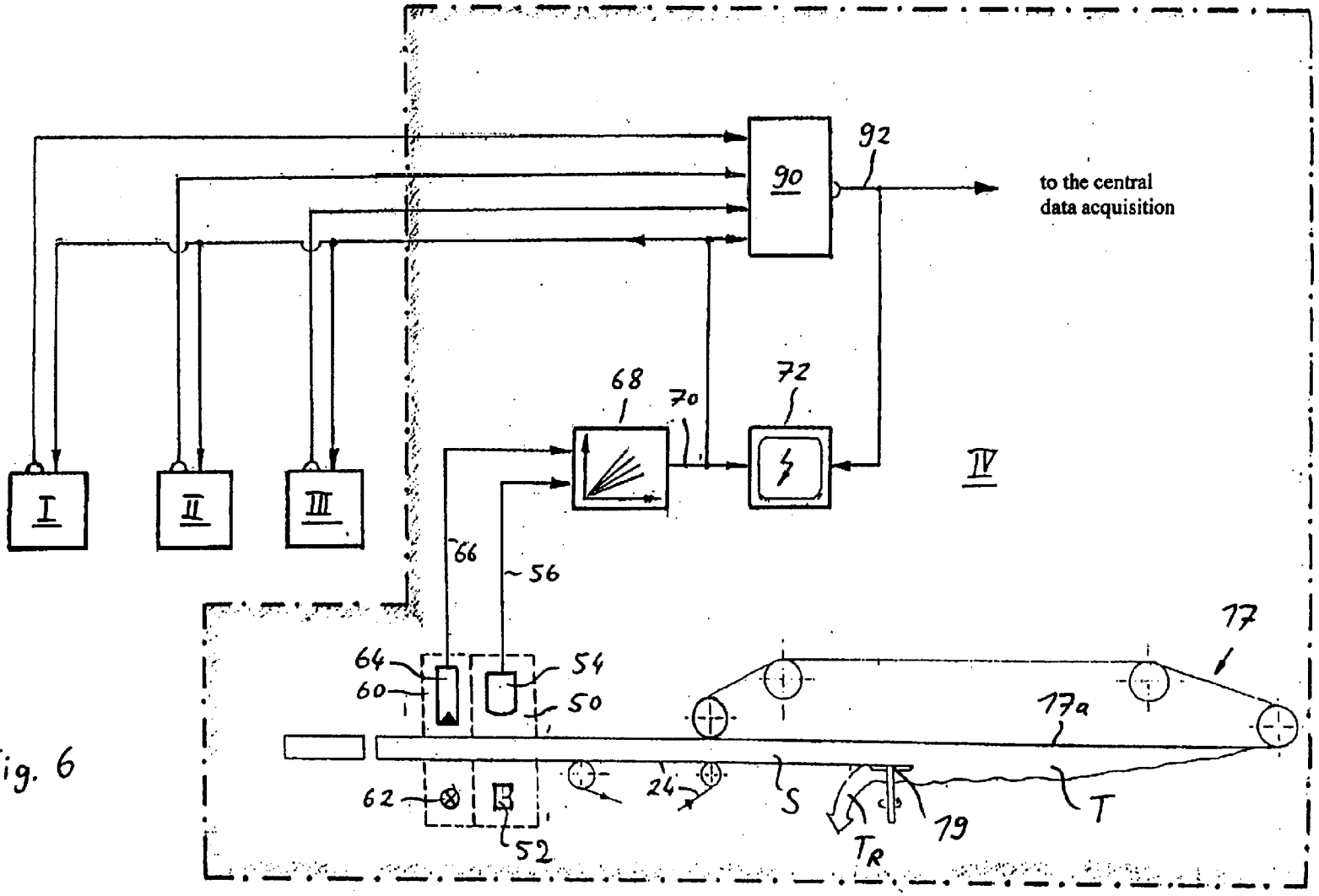
FIG. 6 is a schematic of a system with four parallel operating machines, with each machine having an apparatus according to FIG. 2, which is shown in detail for the fourth machine.

FIG. 6 shows an apparatus with four parallel-operating cigarette rope machines I to IV, which can have the same design as the embodiment shown in FIG. 1 Each of these four machines I to IV, among other things, comprises a measuring device as shown for the first embodiment in FIG. 2, which is shown in further detail in FIG. 6 only in connection with the machine IV for reasons of clarity. FIG. 6 furthermore shows that the machines are networked and that a central device 90 for comparison and analysis is provided, to which the evaluation devices 68 of the individual machines can be connected. The comparison and analysis device 90 evaluates the evaluation signals from the individual machines in a comparative analysis and emits a corresponding data signal 92. This signal is fed back to the display device 72 for each machine and is also transmitted to a central data acquisition system, which is not shown herein.

Information on a possible malfunction, indicating the momentarily offered tobacco mixture does not meet the standard, is obtained by comparing the evaluation signals from the individual machines, in particular if these machines are supplied by the same feeder. If all machines show approximately the same deviation or, if a deviation is detected in only one machine, in particular on the path from the feeder to the cigarette machine, a malfunction exists that generally is the result of an incorrect adjustment or a worn component.

The comparative evaluation in particular suggests itself for double-rope machines where each rope is viewed as a separate machine, In the case of FIG. 6, for example, the machines I and II as well as the machines III and IV can respectively form a double-rope machine.

Figure 7:
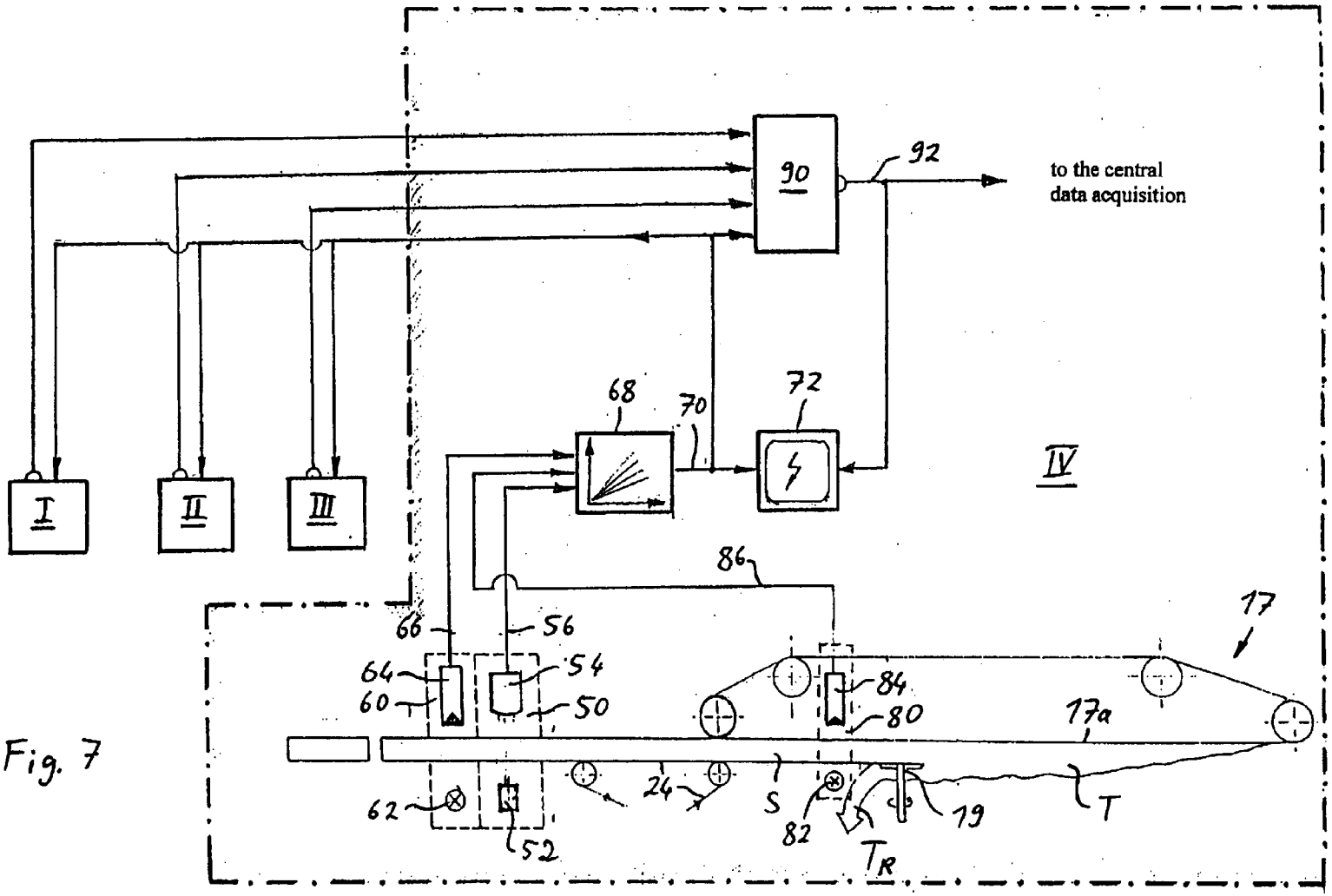
FIG. 7 is a schematic of a system with four parallel operating machines, with each machine having an apparatus according to FIG. 5, which is shown in detail for the fourth machine.

FIG. 7 shows an example of a possible modification as compared to the system shown in FIG. 6. The difference is that the fourth design according to FIG. 5 is implemented as measuring system in the individual machines, which is again shown only for the machine IV for reasons of clarity.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for providing information on at least one characteristic of a fiber rope in the tobacco-processing industry, comprising:

a first measuring device for generating a first measuring signal that essentially only indicates the density of the fiber rope;

a second measuring device for generating a second measuring signal that essentially only represents a function of fiber rope density and fiber geometry; and an evaluation device for receiving the first and second measuring signals and generating an evaluation signal corresponding to fiber structure.

2. An apparatus according to claim 1, wherein the first measuring device includes a first radiation source which emits at least one of beta and microwave radiation that penetrates the fiber rope, and a first sensor that picks up the radiation following penetration of the fiber rope.

3. An apparatus according to claim 1, wherein the second measuring device includes a second radiation source which emits an infrared radiation that penetrates the fiber rope and a second sensor that picks up the infrared radiation once it penetrates the fiber rope.

4. An apparatus according to claim 1, wherein the evaluation device sounds a warning signal if the evaluation signal exceeds or falls below a specific limit value.

5. An apparatus according to claim 1, wherein the evaluation device determines the difference between the first and second measuring signals and generates the evaluation signal as a function of difference.

6. An apparatus according to claim 1, wherein the fiber rope is transported in a longitudinal direction, and the first and second measuring devices are arranged one behind the other along a conveying path for the fiber rope.

7. An apparatus according to claim 1, forming a combination with a system for producing the fiber rope and a control device for controlling the production system with respect to weight of the fiber rope to be produced, wherein the control device receives the first measuring signal as actual value.

8. An apparatus according to claim 1, forming a combination with a system for producing the fiber rope and an arrangement for conveying the produced fiber rope, and the apparatus further including a third measuring device for generating a third measuring signal in the production system which essentially only indicates the density of the fiber rope, the first and second measuring devices being arranged on the conveying arrangement and the evaluation device additionally receiving the third measuring signal and generating the evaluation signal based on the first, second and third measuring signals.

9. An apparatus according to claim 8, wherein the third measuring device comprises a third radiation source which emits infrared radiation that penetrates a fiber rope and a third sensor that picks up the radiation once it penetrates the fiber rope.

10. A system comprising a plurality of apparatuses each according to claim 1, the system further including a comparator device to which the evaluation devices are connected.

11. A method for generating information on at least one characteristic of a fiber rope in the tobacco-processing industry, comprising:

generating a first measuring signal that essentially only indicates the density of the fiber rope;

generating a second measuring signal that essentially represents a function of fiber rope density and fiber geometry; and determining an evaluation signal from the first and second measuring signals which provides information on the fiber structure.

12. The method according to claim 11, where evaluation signal provides information on a deviation from an average fiber structure.

13. The method according to claim 11, wherein the step of generating the first measuring signal includes guiding beta and/or microwave radiation through the fiber rope and subsequently picking up said radiation by a first sensor for generating the first measuring signal.

14. The method according to claim 11, wherein the step of generating the second measuring signal includes guiding an infrared radiation through the fiber rope and subsequently picking up the infrared radiation by the second sensor for generating the second measuring signal.

15. The method according to claim 11, further including sounding a warning signal if the evaluation signal exceeds or falls below a predetermined limit value.

16. The method according to claim 11, wherein the determining step includes determining a difference between the first and the second measuring signal and using the difference to generate an evaluation signal.

17. The method according to claim 16, further including using the first measuring signal as an actual value for controlling a system for producing fiber rope.

18. The method according to claim 16, further including using the first measuring signal as an actual value for controlling a system for producing fiber rope with respect to the weight of the fiber rope to be produced.

19. The method according to claim 11 practiced in a system for producing fiber rope in combination with an arrangement for conveying the produced fiber rope, the method further including generating a third measuring signal which essentially indicates only the density of the fiber rope in the system for producing the fiber rope, wherein the first and second measuring signals are generated on the conveying arrangement of the produced fiber rope downstream of the production system, and the third measuring signal is additionally used for determining the evaluation signal.

20. The method according to claim 19, wherein the third measuring signal indicates the density of the fiber rope at a discharge from the system for producing fiber rope.

21. The method according to claim 19, wherein the step of generating the third measuring signal includes guiding an additional infrared radiation through the fiber rope and subsequently picking up the infrared radiation by a third sensor for generating a third measuring signal.

* * * * *